US011085109B2

(12) United States Patent
Liu et al.

(10) Patent No.: US 11,085,109 B2
(45) **Date of Patent: *Aug. 10, 2021**

(54) METHOD OF MANUFACTURING A CRYSTALLINE ALUMINUM-IRON-SILICON ALLOY

(71) Applicant: GM GLOBAL TECHNOLOGY OPERATIONS LLC, Detroit, MI (US)

(72) Inventors: Zhongyi Liu, Troy, MI (US); Daad B. Haddad, Sterling Heights, MI (US); Tengjiao Qi, Clinton Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 838 days.

This patent is subject to a terminal disclaimer.

(21) Appl. No.: 15/905,223

(22) Filed: Feb. 26, 2018

(65) Prior Publication Data

US 2019/0264308 A1 Aug. 29, 2019

(51) Int. Cl.

| | |
|---|---|
| ***C22F 1/00*** | (2006.01) |
| ***C22C 1/04*** | (2006.01) |
| ***C22C 30/00*** | (2006.01) |
| *B22F 3/02* | (2006.01) |
| *B22F 9/04* | (2006.01) |

(52) U.S. Cl.

CPC ..... *C22F 1/00* (2013.01); *C22C 1/0416* (2013.01); *C22C 30/00* (2013.01); *B22F 3/02* (2013.01); *B22F 9/04* (2013.01); *B22F 2009/043* (2013.01); *B22F 2301/052* (2013.01)

(58) Field of Classification Search

CPC .... B22F 1/0088; B22F 3/02; B22F 2301/052; B22F 9/04; C22C 1/0416; C22C 21/00; C22F 1/00; C22F 1/04

USPC ..... 419/28; 420/129

See application file for complete search history.

(56) References Cited

U.S. PATENT DOCUMENTS

| | | | | |
|---|---|---|---|---|
| 4,878,967 | A * | 11/1989 | Adam | B22F 9/008 148/437 |
| 10,519,531 | B2 * | 12/2019 | Liu | B33Y 70/00 |
| 2014/0109895 | A1 * | 4/2014 | Ren | F28D 20/02 126/714 |

FOREIGN PATENT DOCUMENTS

JP 1993331585 A 12/1993

OTHER PUBLICATIONS

Nataliya Krendelsberger et al; On the Reaction Scheme and Liquidus Surface in the Ternary System Al—Fe—Si; Metallurgical and Materials Transactions A, vol. 38 A, Aug. 2007; pp. 1681-1691.

(Continued)

*Primary Examiner* — Jie Yang
(74) *Attorney, Agent, or Firm* — Quinn IP Law

(57) ABSTRACT

A method of manufacturing a crystalline aluminum-iron-silicon alloy and a crystalline aluminum-iron-silicon alloy part. An aluminum-, iron-, and silicon-containing composite powder is provided that includes an amorphous phase and a first crystalline phase having a hexagonal crystal structure at ambient temperature. The composite powder is heated at a temperature in the range of 850° C. to 950° C. to transform at least a portion of the amorphous phase into the first crystalline phase and to transform the composite powder into a crystalline aluminum-iron-silicon (Al—Fe—Si) alloy. The first crystalline phase is a predominant phase in the crystalline Al—Fe—Si alloy.

20 Claims, 2 Drawing Sheets

(56) References Cited

OTHER PUBLICATIONS

Martin C.J. Marker et al; Phase equilibria and structural investigations in the system Al—Fe—Si; Elsevier, Intermetallics 19, May 2, 2011, pp. 1919-1929.
Martin C.J. Marker et al; Characterization of the Fe-rich corner of Al—Fe—Si—Ti; Elsevier; Intermetallics 39, Mar. 2, 2013; pp. 38-49.

* cited by examiner

METHOD OF MANUFACTURING A CRYSTALLINE ALUMINUM-IRON-SILICON ALLOY

INTRODUCTION

Iron aluminides (e.g., FeAl and $Fe_3Al$) are intermetallic compounds having a defined stoichiometry and an ordered crystal structure. Many iron aluminides exhibit excellent high-temperature oxidation resistance, relatively low densities, high melting points, high strength-to-weight ratios, good wear resistance, ease of processing, and low production cost since they generally do not incorporate rare elements, which makes them attractive substitutes for stainless steel in industrial applications. However, at low to moderate temperatures, iron aluminides oftentimes suffer from poor ductility and low fracture toughness. At elevated temperatures, iron aluminides have been found to exhibit limited creep resistance and high thermal conductivity. Increasing the aluminum content of such materials can decrease their density and enhance the formation of a protective oxide layer at high temperatures, but also may significantly lower their ductility in moisture-containing environments (e.g., air) due to a phenomenon known as hydrogen embrittlement.

Ternary Al—Fe—Si intermetallic compounds are of interest for alloy development due to their potential advantageous properties. In particular, the addition of silicon into the Al—Fe binary system has the potential to produce a ternary Al—Fe—Si intermetallic compound with a crystal structure that exhibits a combination of relatively low density and good mechanical properties, e.g., good stiffness and ductility. Therefore, there is a need in the art for a method of manufacturing a crystalline Al—Fe—Si alloy with a defined stoichiometry and an ordered crystal structure that exhibits a relatively low density and a desirable combination of good chemical, thermal, and mechanical properties.

SUMMARY

In a method of manufacturing a crystalline aluminum-iron-silicon alloy, an aluminum-, iron-, and silicon-containing composite powder may be provided. The composite powder may include an amorphous phase and a first crystalline phase having a hexagonal crystal structure at ambient temperature. The composite powder may be heated at a temperature in the range of 850° C. to 950° C. to transform at least a portion of the amorphous phase into the first crystalline phase and to transform the composite powder into a crystalline aluminum-iron-silicon (Al—Fe—Si) alloy. The first crystalline phase may comprise a predominant phase in the crystalline Al—Fe—Si alloy.

The crystalline Al—Fe—Si alloy may not include an amorphous phase.

The first crystalline phase may comprise, on an atomic basis, 64-66.5% aluminum (Al), 24-25% iron (Fe), and 9.5-11% silicon (Si).

The first crystalline phase may exhibit lattice parameters of a=0.7509 nm±0.005 nm and c=0.7594 nm±0.005 nm.

The first crystalline phase may exhibit a $P6_3/mmc$ crystallographic space group.

The first crystalline phase may have a density of less than 5.0 g/cm$^3$.

The first crystalline phase may account for greater than 65%, by weight, of the crystalline Al—Fe—Si alloy. In addition, the crystalline Al—Fe—Si alloy may comprise a second crystalline phase that exhibits at least one of an orthorhombic or a triclinic crystal structure. In such case, the second crystalline phase may account for less than 32%, by weight, of the crystalline Al—Fe—Si alloy.

The composite powder may be heated at a temperature in the range of 900° C. to 930° C. to transform at least a portion of the amorphous phase into the first crystalline phase. In such case, the first crystalline phase may account for greater than 85%, by weight, of the crystalline Al—Fe—Si alloy. The crystalline Al—Fe—Si alloy also may comprise a second crystalline phase that exhibits at least one of an orthorhombic or a triclinic crystal structure. In such case, the second crystalline phase may account for less than 15%, by weight, of the crystalline Al—Fe—Si alloy.

The composite powder may comprise, by weight, 41-55% aluminum (Al), 33-48% iron (Fe), and 9-13% silicon (Si).

The composite powder is prepared by providing an aluminum-, iron-, and silicon-containing precursor material in powder form and mechanically alloying the precursor material. The aluminum-, iron-, and silicon-containing precursor material may comprise at least one of a mixture of metal powders or a pre-alloyed metal powder.

The composite powder may not be formed by rapid solidification of a molten material.

In a method of manufacturing a crystalline aluminum-iron-silicon alloy part, an aluminum-, iron-, and silicon-containing composite powder may be provided. The composite powder may include an amorphous phase and a first crystalline phase having a hexagonal crystal structure at ambient temperature. The composite powder may be introduced into a die. The composite powder may be heated in the die at a temperature in the range of 850° C. to 950° C. to transform at least a portion of the amorphous phase into the first crystalline phase and to transform the composite powder into a crystalline aluminum-iron-silicon (Al—Fe—Si) alloy. The first crystalline phase may be a predominant phase in the crystalline Al—Fe—Si alloy. The crystalline Al—Fe—Si alloy may be consolidated in the die to produce a solid crystalline Al—Fe—Si alloy part.

The composite powder may be heated in the die for a duration in the range of 0.5 hours to 36 hours.

The composite powder may be exposed to a sub-atmospheric pressure environment or to an inert environment in the die.

The crystalline Al—Fe—Si alloy may be consolidated in the die using at least one powder metallurgy process selected from the group consisting of: compaction, sintering, hot forging, powder forging, hot consolidation, hot pressing, hot isostatic pressing, cold isostatic pressing, and hot extrusion.

The crystalline Al—Fe—Si alloy may be consolidated within the die by heating the crystalline Al—Fe—Si alloy at a temperature in the range of 800° C. to 950° C. and applying a pressure to the crystalline Al—Fe—Si alloy in the range of 100 kN/m$^2$ to 500 kN/m$^2$ for a duration in the range of 20 seconds to 40 seconds.

The crystalline Al—Fe—Si alloy part may comprise a component for an internal combustion engine.

DETAILED DESCRIPTION

Figure 1:
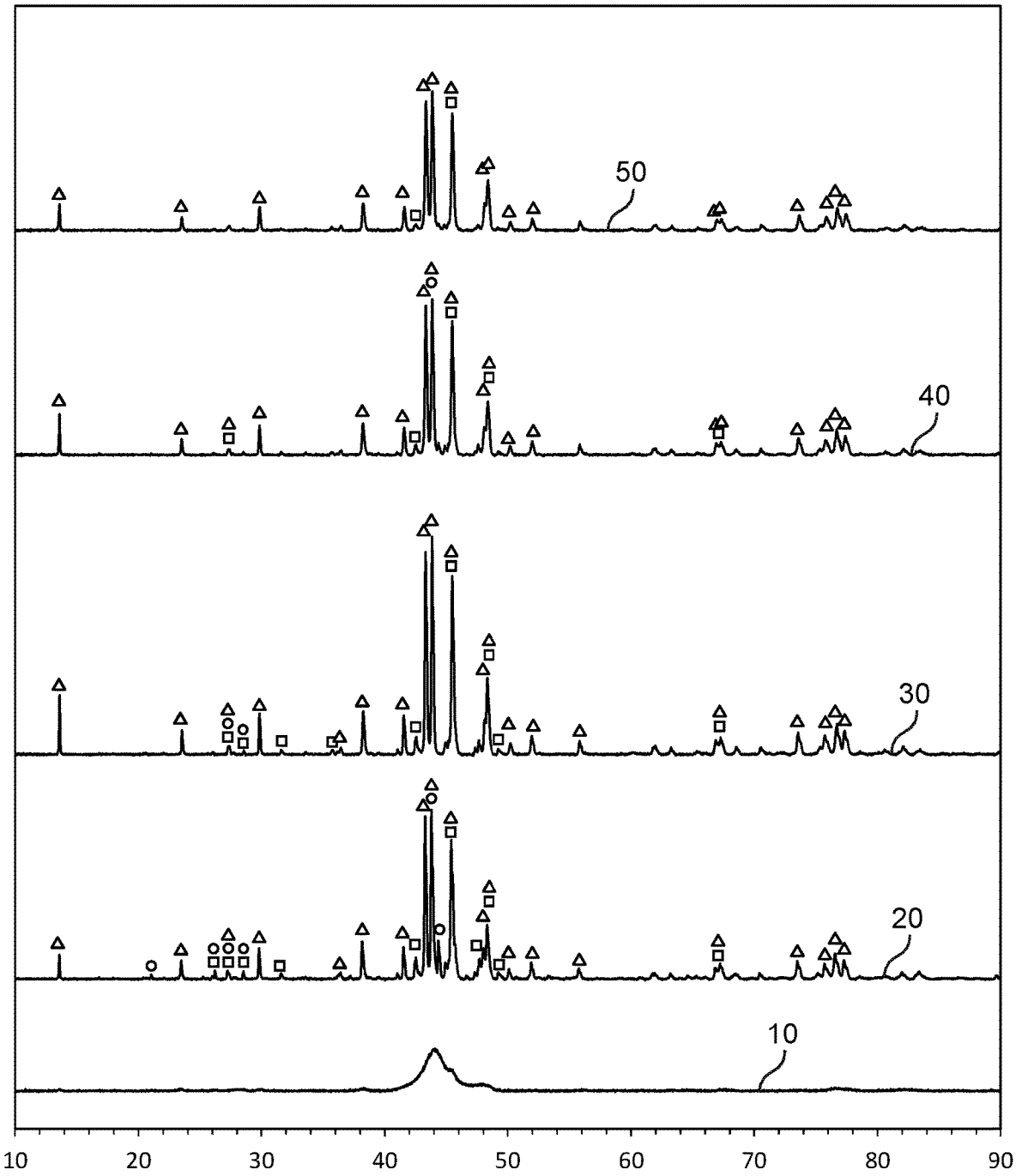
FIGS. 1 and 2 depict x-ray diffraction patterns of a partially amorphous Al—Fe—Si composite powder (10) and four different crystalline Al—Fe—Si alloy samples: Sample 1 (20), Sample 2 (30), Sample 3 (40), and Sample 4 (50). Representative peaks of a hexagonal Al—Fe—Si crystalline phase are labeled with triangles (Δ), representative peaks of an orthorhombic Al—Fe—Si crystalline phase are labeled with circles (○), and representative peaks of a triclinic Al—Fe—Si crystalline phase are labeled with squares (□).

The presently disclosed mechanical alloying and heat treatment method can be used to manufacture a crystalline aluminum-iron-silicon alloy having a desired microstructure and exhibiting relatively high ductility, as compared to aluminum-iron-silicon alloys having the same chemical composition that have not been subjected to such a method. In addition, the presently disclosed mechanical alloying and heat treatment method can be used in combination with one or more powder metallurgical processes to manufacture shaped crystalline aluminum-iron-silicon alloy parts.

As used herein, the term "aluminum-iron-silicon alloy" refers to a material that comprises aluminum (Al) as the single largest constituent of the material by weight, as well as alloying elements of iron (Fe) and silicon (Si). This may mean that the aluminum-iron-silicon alloy comprises, by weight, greater than 50% aluminum or less than 50% aluminum, so long as elemental aluminum is the single largest constituent of the alloy by weight. Iron and silicon are included in the aluminum-iron-silicon alloy to impart certain desirable properties to the alloy that are not exhibited by pure aluminum.

An aluminum-iron-silicon alloy composition for manufacturing shaped crystalline aluminum-iron-silicon alloy parts via powder metallurgy may comprise, in addition to aluminum, alloying elements of iron (Fe) and silicon (Si), and thus may be referred to herein as an Al—Fe—Si alloy. The respective amounts of iron and silicon included in the Al—Fe—Si alloy may be selected to impart certain desirable properties to the Al—Fe—Si alloy that are not exhibited by pure aluminum. For example, the Al—Fe—Si alloy may comprise, by weight, greater than or equal to 41% or 43% aluminum; less than or equal to 55% or 51% aluminum; or between 41-55% or 43-51% aluminum. The Al—Fe—Si alloy may comprise, by weight, greater than or equal to 33% or 38% iron; less than or equal to 48% or 42% iron; or between 33-48% or 38-42% iron. The Al—Fe—Si alloy may comprise, by weight, greater than or equal to 8% or 9% silicon; less than or equal to 13% or 12% silicon; or between 8-13% or 9-12% silicon.

Additional elements not intentionally introduced into the composition of the Al—Fe—Si alloy nonetheless may be inherently present in the alloy in relatively small amounts, for example, less than 4.5%, preferably less than 2.0%, and more preferably less than 0.02% by weight of the Al—Fe—Si alloy. Such elements may be present, for example, as impurities in the raw materials used to prepare the Al—Fe—Si alloy composition. In embodiments where the Al—Fe—Si alloy is referred to as comprising one or more alloying elements (e.g., one or more of Fe and Si) and aluminum as balance, the term "as balance" does not exclude the presence of additional elements not intentionally introduced into the composition of the Al—Fe—Si alloy but nonetheless inherently present in the alloy in relatively small amounts, e.g., as impurities.

The respective amounts of Al, Fe, and Si in the Al—Fe—Si alloy are selected to provide the alloy with the ability to develop a desired crystalline structure during manufacture. In particular, the respective amounts of Al, Fe, and Si in the Al—Fe—Si alloy are selected to provide the alloy with the ability to develop a crystalline structure that predominantly comprises a stable Al—Fe—Si crystalline phase known as $\tau_{10}$ or $\tau_{11}$ when the Al—Fe—Si alloy is subjected to a mechanical alloying stage and a subsequent heat treatment stage. This stable Al—Fe—Si crystalline phase has a hexagonal crystal structure at ambient temperature (i.e., 25° C.) and may be referred to herein as the "h-Al—Fe—Si crystalline phase." The h-Al—Fe—Si crystalline phase may have a lattice parameter a of about 0.7509 nm and a lattice parameter c of about 0.7594 nm. For example, the h-Al—Fe—Si crystalline phase may have a lattice parameter a of 0.7509 nm±0.005 nm and a lattice parameter c of 0.7594 nm±0.005 nm. The ratio of the lattice parameters c/a in the h-Al—Fe—Si crystalline phase is close to one (e.g., greater than about 1.01) indicating that the crystal lattice structure of the h-Al—Fe—Si crystalline phase is close to that of a distorted face centered cubic (fcc) crystal lattice structure. The h-Al—Fe—Si crystalline phase may exhibit a $P6_3/mmc$ crystallographic space group. In addition, the Pearson symbol of for the h-Al—Fe—Si crystalline phase may be hP28, indicating that the h-Al—Fe—Si crystalline phase is in the hexagonal crystal system, has a primitive-type lattice structure, and includes 28 atoms in a crystal unit cell. The density of the h-Al—Fe—Si crystalline phase is less than 5.0 g/cm$^3$. For example, the density of the h-Al—Fe—Si crystalline phase may be in the range of 4.0 g/cm$^3$ to 4.2 g/cm$^3$. In one form, the h-Al—Fe—Si crystalline phase may have a density of 4.1 g/cm$^3$. The h-Al—Fe—Si crystalline phase may be represented by the following empirical formula: $Al_xFe_ySi_z$, wherein $4 \leq x \leq 5$; $1.5 \leq y \leq 2.2$; and $z=1$. In one form, the h-Al—Fe—Si crystalline phase may be represented by the following empirical formula: $Al_4Fe_{1.7}Si$. In practice, the h-Al—Fe—Si crystalline phase may comprise, on an atomic basis, 64-66.5% aluminum, 24-25% iron, and 9.5-11% silicon. It has been found that, in practice, the respective amounts of aluminum, iron, and silicon in the h-Al—Fe—Si crystalline phase in the crystalline Al—Fe—Si alloy may be somewhat different than the amounts predicted by the empirical formulas described above.

Formation of the h-Al—Fe—Si crystalline phase as the predominant phase in the crystalline Al—Fe—Si alloy, and preservation thereof at ambient temperature, can impart certain desirable properties to the crystalline Al—Fe—Si alloy. For example, when the h-Al—Fe—Si crystalline phase is preserved as the predominant phase within the crystalline Al—Fe—Si alloy at ambient temperature, the Al—Fe—Si alloy may be relatively lightweight, may exhibit exceptional mechanical strength at high temperatures, high oxidation resistance, and relatively high stiffness and ductility, as compared to partially amorphous Al—Fe—Si alloys or Al—Fe—Si alloy in which other crystalline phases predominate. As used herein in reference to a particular phase within the Al—Fe—Si alloy, the term "predominant" and its various word forms and conjugates means that such phase is the single largest phase in the Al—Fe—Si alloy by weight, with the weight fraction of the predominant phase in the Al—Fe—Si alloy being greater than the weight fraction of all other phases in the Al—Fe—Si alloy, taken individually or in combination.

Without intended to be bound by theory, it is believed that the relatively high stiffness and ductility of the crystalline Al—Fe—Si alloy may be due to the unique crystal structure of the h-Al—Fe—Si crystalline phase. In particular, the h-Al—Fe—Si crystalline phase exhibits a hexagonal close packed (hcp) crystal structure with a c/a ratio of about 1.01, which is significantly lower than the ideal c/a ratio of 1.63. The relatively low c/a ratio of the h-Al—Fe—Si crystalline phase indicates that the lattice places in the h-Al—Fe—Si crystalline phase are highly compressed, making it relatively easy for the planes of atoms to slide past each other when subjected to an applied stress, as compared to hcp crystal structures with relatively high c/a ratios (e.g., closer to 1.63). As such, the h-Al—Fe—Si crystalline phase may exhibit relatively high stiffness and ductility, and may deform more readily under load before breaking, as compared to crystal structures with lattice planes that are not as closely packed.

It has been found that, at equilibrium, the h-Al—Fe—Si crystalline phase is generally only stable at temperatures in the range of 727° C. to 997° C., and may transform to other solid phases when allowed to cool from such temperatures to ambient temperature at a relatively slow rate, e.g., at rates less than one (1) Kelvin per second. Therefore, the successful formation and preservation of an h-Al—Fe—Si crystalline phase within the crystalline Al—Fe—Si alloy at ambient temperature has previously been thought to require heating the Al—Fe—Si alloy to temperatures at or above the melting point of the Al—Fe—Si alloy (e.g., at or above 1250° C.), followed by rapid solidification of the alloy to ambient temperature to form and retain an h-Al—Fe—Si crystalline phase in the crystalline Al—Fe—Si alloy at ambient temperature. For example, preservation of a metastable h-Al—Fe—Si crystalline phase within the crystalline Al—Fe—Si alloy at ambient temperature has previously been thought to require a volume of molten Al—Fe—Si alloy material to be cooled at a rate of greater than ten (10) Kelvin per second, such as by immersing the volume of material in a liquid medium, e.g., water or oil. Even faster cooling rates of about $10^2$ Kelvin per second and about $10^5$ Kelvin per second were also used and were respectively achieved by water-cooled crucible solidification and melt-spinning. However, it has been found that, when such rapid solidification techniques are employed, the resulting h-Al—Fe—Si crystalline phase will typically only represent a minor weight fraction of the Al—Fe—Si alloy, and thus may not exist as the predominant phase in the Al—Fe—Si alloy.

According to embodiments of the present disclosure, a crystalline Al—Fe—Si alloy that predominantly comprises an h-Al—Fe—Si crystalline phase at ambient temperature (i.e., 25° C.) may be manufactured by a method that includes a mechanical alloying stage and a subsequent heat treatment stage. Both the mechanical alloying stage and the subsequent heat treatment stage are performed in the solid state, without melting the Al—Fe—Si alloy.

In the mechanical alloying stage, an aluminum-, iron-, and silicon-containing precursor material is provided in powder form. The amounts of aluminum, iron, and silicon provided in the precursor material may correspond to the respective amounts of aluminum, iron, and silicon present in the Al—Fe—Si alloy. For example, the precursor material may comprise, by weight, 41-55% aluminum, 33-48% iron, and 9-13% silicon. The precursor material may comprise a mixture of metal powders and/or a pre-alloyed metal powder. For example, the precursor material may comprise a mixture of an aluminum powder, an iron powder, and a silicon powder. Additionally or alternatively, the precursor material may comprise particles of an aluminum-, iron-, and/or silicon-containing alloy. The metal powder(s) used to prepare the powdered precursor material may be formed, for example, via a rapid solidification process, such as an atomization process.

The powdered precursor material may be mechanically alloyed, for example, using a high-energy ball milling process wherein the precursor material is repeatedly subjected to plastic deformation until an aluminum-, iron-, and silicon-containing (Al—Fe—Si) composite powder is produced. The Al—Fe—Si composite powder is at least partially amorphous at ambient temperature (i.e., 25° C.) and may comprise an amorphous phase and one or more crystalline phases. The amorphous phase may comprise, by weight, greater than one (1) percent of the composite powder. At the same time, the one or more crystalline phases may comprise, by weight, less than 65% of the composite powder. In one form, the composite powder may consist of an amorphous phase and an h-Al—Fe—Si crystalline phase, with no other crystalline phases present in the composite powder.

The high-energy ball milling process may be accomplished by introducing the precursor material into any suitable high-energy ball milling apparatus. Examples of high-energy ball milling apparatuses include vibratory ball mills, rotary ball mills, planetary ball mills, shaker mills, and attrition mills. In practice, the precursor material may be introduced into a drum, tank, jar, or other milling vessel of the ball milling apparatus along with milling or grinding media. During operation of the ball milling apparatus, the milling or grinding media repeatedly impact the precursor material, resulting in the repeated flattening, cold welding, fracturing and rewelding of the powder particles until an aluminum-, iron-, and silicon-containing composite powder is formed.

The drum, tank, jar, or other milling vessel of the ball milling apparatus may be formed of a material that will not chemically react with the precursor material and will not cause the precursor material to stick or bond thereto during the ball milling process. For example, the drum, tank, jar, or other milling vessel of the ball milling apparatus may be formed of stainless steel, hardened steel, tungsten carbide, alumina ceramic, zirconia ceramic, silicon nitride, agate, or another suitably hard material. The milling or grinding media may comprise milling balls. The milling balls may be made of stainless steel, hardened steel, tungsten carbide, alumina ceramic, zirconia ceramic, silicon nitride, agate, or another suitably hard non-reactive material. In one form, the milling balls may include at least one small ball (having a diameter ranging from about 3 mm to about 7 mm) and at least one large ball (having a diameter ranging from about 10 mm to about 13 mm). The ratio of large balls to small balls may be 1:2. For example, the milling balls may include two small balls, each of which has a diameter of about 6.2 mm, and one large ball having a diameter of about 12.6 mm. The number of large and small balls, as well as the size of the balls, may be adjusted as desired.

The ball milling process may be performed at a relatively low temperature without melting the aluminum-, iron-, and/or silicon-containing constituents of the composite powder. For example, the ball milling process may be performed at a temperature of less than 150° C. The ball milling process may be performed in an environment containing a non-reactive or inert gas, such as argon, helium, neon, or nitrogen. It may be desirable to perform the ball milling process in the absence of oxygen gas, for example, in the absence of air, to prevent the formation of oxides on the surface of the precursor material particles.

The ball milling process may be performed at a speed and for a duration sufficient to transform the precursor material into a composite powder including an amorphous phase and one or more crystalline phases. For example, the ball milling process may be performed at a speed of 1060 cycles per minute (115 V mill) or 875 cycles per minute (230 V mill). The ball milling process may be performed for a duration of in the range of 8 hours to 32 hours. The duration of the ball milling process may vary depending upon the volume or mass of the precursor material introduced into the ball milling apparatus.

In some embodiments, a liquid medium may be introduced into the drum, tank, jar, or other milling vessel of the ball milling apparatus along with the precursor material and the milling or grinding media prior to carrying out the ball milling process. In one form, the liquid medium may be added to prevent malleable constituents of the precursor material (e.g., aluminum) from adhering or sticking to interior surfaces of the ball milling vessel. Additionally or alternatively, the liquid medium may facilitate uniform mixing and alloying of the aluminum-, iron-, and silicon-containing constituents of the precursor material. The liquid medium may comprise any liquid that will not chemically react with (e.g., oxidize) the precursor material. For example, the liquid medium may comprise an anhydrous liquid, such as a linear hydrocarbon (e.g., pentane, hexane, and/or heptane) or a cyclic or aromatic hydrocarbon. As another example, the liquid medium may comprise a fluorinated solvent or a stable organic solvent with non-reactive elemental oxygen. The ratio of the volume of the precursor material to the volume of the liquid medium may be in the range of 1:5 to 1:10. For example, the liquid medium may be added to the precursor material in the ball milling apparatus in an amount comprising, by volume, 80% to 95% of the precursor material. Most or all of the liquid medium may be released from the precursor material during the mechanical alloying stage or during the subsequent heat treatment stage so that the final crystalline Al—Fe—Si alloy does not contain any amount of residual liquid medium.

The heat treatment stage is performed after completion of the mechanical alloying stage. In the heat treatment stage, the composite powder is heated at a sufficient temperature and for a sufficient duration to transform the composite powder into a fully crystalline Al—Fe—Si alloy that predominantly comprises an h-Al—Fe—Si crystalline phase. The resulting Al—Fe—Si alloy is "fully crystalline," meaning that the resulting Al—Fe—Si alloy is 100% crystalline and does not comprise any amorphous phases. The composite powder may be subjected to the heat treatment stage to transform at least a portion of the amorphous phase into an h-Al—Fe—Si crystalline phase.

The heat treatment stage may involve heating the composite powder at a temperature above the lowest temperature at which the h-Al—Fe—Si crystalline phase is stable at equilibrium (e.g., about 727° C.), but below the highest temperature at which the h-Al—Fe—Si crystalline phase is stable at equilibrium (e.g., about 997° C.) for a duration in the range of 0.5 hours to 36 hours. For example, the heat treatment process may involve heating the composite powder at a temperature in the range of 850° C. to 950° C. for a duration in the range of 0.5 hours to 36 hours. In one specific example, the heat treatment process may involve heating the composite powder at a temperature in the range of 910° C. to 930° C. for a duration in the range of 20 hours to 30 hours.

The temperature and duration of the heat treatment process are selected to produce a crystalline Al—Fe—Si alloy that predominantly comprises an h-Al—Fe—Si crystalline phase. Without intending to be bound by theory, it is believed that, depending on the temperature at which the heat treatment stage is performed, the amorphous phase initially present in the composite powder may or may not directly transform into an h-Al—Fe—Si crystalline phase during the heat treatment stage. For example, in some instances, the amorphous phase may transition to one or more different Al—Fe—Si crystalline phases at an intermediate step in the heat treatment stage, with at least a portion of these Al—Fe—Si crystalline phases subsequently transitioning to the h-Al—Fe—Si crystalline phase by the end of the heat treatment stage. The one or more different Al—Fe—Si crystalline phases may have orthorhombic and/or triclinic crystal structures at ambient temperature (i.e., 25° C.). One example of an Al—Fe—Si crystalline phase having an orthorhombic crystal structure that may be produced during the heat treatment stage is known as T3 and may be referred to herein as the "o-Al—Fe—Si crystalline phase." One example of an Al—Fe—Si crystalline phase having a triclinic crystal structure that may be produced during the heat treatment stage is known as T1 and may be referred to herein as the "t-Al—Fe—Si crystalline phase."

In some instances, the amorphous phase may transition to an o-Al—Fe—Si and/or t-Al—Fe—Si crystalline phase at an intermediate step in the heat treatment stage, with at least a portion of the o-Al—Fe—Si and/or t-Al—Fe—Si crystalline phases subsequently transitioning to the h-Al—Fe—Si crystalline phase by the end of the heat treatment stage. As such, the temperature and duration of the heat treatment stage is preferably selected so that, regardless of whether any other non-hexagonal crystalline phases (e.g., o-Al—Fe—Si and/or t-Al—Fe—Si crystalline phases) form during an intermediate step in the heat treatment stage, the h-Al—Fe—Si crystalline phase is the predominant crystalline phase in the resulting crystalline Al—Fe—Si alloy. In one form, after the heat treatment stage is complete, the h-Al—Fe—Si crystalline phase may comprise, by weight, greater than 65% of the crystalline Al—Fe—Si alloy. More specifically, after the heat treatment stage is complete, the h-Al—Fe—Si crystalline phase may comprise, by weight, 70-90% of the crystalline Al—Fe—Si alloy.

The resulting crystalline Al—Fe—Si alloy may include relatively small amounts of other non-hexagonal crystalline phases. For example, the crystalline Al—Fe—Si alloy may predominantly comprise an h-Al—Fe—Si crystalline phase and also may include, by weight, less than 35% of one or more other non-hexagonal crystalline phases. The combined amounts of the o-Al—Fe—Si crystalline phase and the t-Al—Fe—Si crystalline phase in the crystalline Al—Fe—Si alloy may account for, by weight, less than 35% or, more preferably, less than 15% of the of the crystalline Al—Fe—Si alloy. For example, the o-Al—Fe—Si crystalline phase may comprise, by weight, less than 15% of the crystalline Al—Fe—Si alloy and the t-Al—Fe—Si crystalline phase may comprise, by weight, less than 20% of the crystalline Al—Fe—Si alloy. In one specific example, after the heat treatment process is complete, the h-Al—Fe—Si crystalline phase may comprise, by weight, greater than or equal to 85% of the crystalline Al—Fe—Si alloy, the o-Al—Fe—Si crystalline phase may comprise, by weight, less than 3% of the crystalline Al—Fe—Si alloy, and the t-Al—Fe—Si crystalline phase may comprise, by weight, less than 10% of the crystalline Al—Fe—Si alloy.

According to embodiments of the present disclosure, the partially amorphous Al—Fe—Si composite powder and the crystalline Al—Fe—Si alloy are not formed by rapid solidification of a molten material. In particular, the partially amorphous Al—Fe—Si composite powder and the crystalline Al—Fe—Si alloy are not formed by cooling a molten material to ambient temperature at a rate of greater than or equal to one (1) Kelvin per second.

The crystalline Al—Fe—Si alloy may be formed into a desired shape before, during, or after the heat treatment stage via any suitable powder metallurgy process or processes. Some examples of powder metallurgy processes that may be used individually or in combination to form the crystalline Al—Fe—Si alloy into a desired shape include:

compaction, sintering, hot forging, powder forging, hot consolidation, hot pressing in rigid dies (die compaction), hot pressing, hot isostatic pressing, cold isostatic pressing, and hot extrusion. All of these processes must be performed in a controlled non-oxidizing environment, e.g., by creating a sub-atmospheric pressure environment or an inert environment.

In one form, a crystalline Al—Fe—Si alloy exhibiting a desired shape and having a predominant h-Al—Fe—Si crystalline phase may be manufactured using a hot pressing process. In a first stage of the process, an Al-, Fe-, and Si-containing powder may be introduced into a die and consolidated within the die at a temperature in the range of 850° C. to 950° C. to transform the Al-, Fe-, and Si-containing powder into a unitary one-piece solid mass exhibiting a desired shape. The Al-, Fe-, and Si-containing powder may comprise a partially amorphous Al—Fe—Si composite powder or a crystalline Al—Fe—Si alloy powder having a predominant h-Al—Fe—Si crystalline phase.

In embodiments where the Al-, Fe-, and Si-containing powder comprises a partially amorphous Al—Fe—Si composite powder, the composite powder may be heat treated during the hot pressing process to transform the composite powder into a crystalline Al—Fe—Si alloy exhibiting a desired shape and having a predominant h-Al—Fe—Si crystalline phase. In such case, the partially amorphous Al—Fe—Si composite powder may be introduced into the die at ambient temperature and then heated in the die to a temperature greater than 800° C. (e.g., about 820° C.) at a rate of about 50 degrees Celsius per minute. Thereafter, pressure in the range of 100 $kN/m^2$ to 500 $kN/m^2$ may be applied to the composite powder within the die for a duration in the range of 20 seconds to 40 seconds while the composite powder is further heated to a temperature in the range of 850° C. to 950° C. to consolidate the composite powder into a unitary one-piece solid mass exhibiting a desired shape and to transform the composite powder into a crystalline Al—Fe—Si alloy having a predominant h-Al—Fe—Si crystalline phase. The shaped crystalline Al—Fe—Si alloy may be cooled to ambient temperature in the die at a rate of less than one (1) Kelvin per second using liquid nitrogen. The shaped crystalline Al—Fe—Si alloy may be removed from the die after it has been cooled to ambient temperature.

In embodiments where the Al-, Fe-, and Si-containing powder introduced into the die is already in the form of a crystalline Al—Fe—Si alloy powder having a predominant h-Al—Fe—Si crystalline phase, the crystalline Al—Fe—Si alloy powder may be consolidated in the die at ambient temperature or heated in the die at a temperature in the range of 850° C. to 950° C. and a pressure in the range of 100 $kN/m^2$ to 500 $kN/m^2$ may be applied to the powder for a duration in the range of 20 seconds to 40 seconds to consolidate the powder into a unitary one-piece solid mass exhibiting a desired shape. Thereafter, the shaped crystalline Al—Fe—Si alloy may be cooled to ambient temperature in the die at a rate of less than one (1) Kelvin per second using liquid nitrogen. The shaped crystalline Al—Fe—Si alloy may be removed from the die after it has been cooled to ambient temperature.

EXAMPLES

An aluminum-, iron-, and silicon-containing precursor material was prepared in powder form, samples of the precursor material were mechanically alloyed and heat treated at different temperatures and durations to produce crystalline Al—Fe—Si alloy samples comprising varying amounts of a h-Al—Fe—Si crystalline phase. X-ray powder diffraction was used to identify the crystalline phases present in the resulting crystalline Al—Fe—Si alloy samples.

Three (3) grams the precursor material were prepared under argon gas by weighing out and mixing together appropriate amounts of a 99.5% pure aluminum powder from Alfa Aesar (Stock #11067, Lot #A26127), a 97% pure iron powder from J.T. Baker (Lot M47600), and a 99.5% pure silicon powder from Alfa Aesar (Stock #12681, Lot #G08H24). The amount of each of the aluminum, iron, and silicon powders used to prepare the precursor material are shown in Table 1 below.

TABLE 1

| | Target Weight (%) | Target Weight (g) | Actual Weight (g) |
|---|---|---|---|
| Al powder | 46.73 | 1.4019 | 1.4010 |
| Fe powder | 41.10 | 1.2330 | 1.2335 |
| Si powder | 12.17 | 0.3651 | 0.3652 |

The as-prepared precursor material was placed under argon gas into a ball milling jar along with a suitable amount of pentane (available from VWR International) and three (3) milling balls. The three milling balls included two 6.20 mm diameter small balls and one 12.65 mm diameter large ball. Ball milling of the as-prepared precursor material was performed at ambient temperature using an SPEX SamplePrep 8000M MIXER/MILL® for 32 hours to produce a partially amorphous and partially crystalline composite powder.

Figure 2:
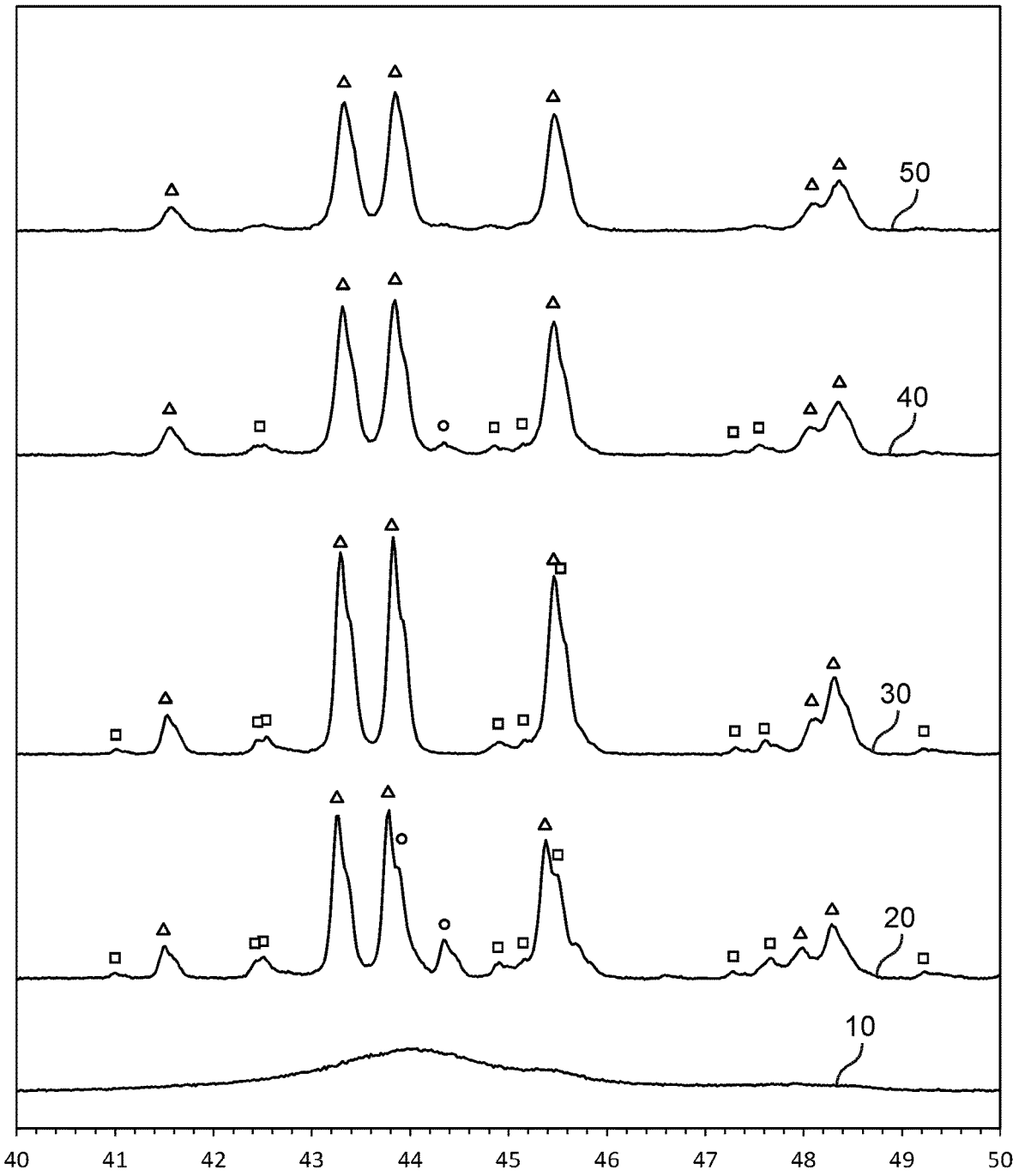

X-ray diffraction was performed on the resulting composite powder using a Bruker D8 Advance X-Ray diffraction system and a Rigaku X-ray Diffraction system. FIGS. 1 and 2 depict an x-ray diffraction (XRD) pattern of the as-prepared composite powder (10). The XRD pattern of the as-prepared composite powder (10) does not include any sharp peaks, indicating that the composite powder is not 100% crystalline and is at least partially amorphous at ambient temperature.

Samples of the composite powder were heat treated at different temperatures and durations to produce crystalline Al—Fe—Si alloy samples comprising varying amounts of the h-Al—Fe—Si, o-Al—Fe—Si, and t-Al—Fe—Si crystalline phases. After the samples were heat treated, the samples were cooled to ambient temperature at a rate of less than one (1) Kelvin per second, e.g., about five (5) Kelvin per minute. The specific temperature and duration of heat treatment for each of the Samples is shown in Table 2 below.

TABLE 2

| | Temperature (° C.) | Duration (hours) |
|---|---|---|
| Sample 1 | 850 | 0.5 |
| Sample 2 | 945 | 5 |
| Sample 3 | 850 | 24 |
| Sample 4 | 920 | 24 |

FIGS. 1 and 2 depict x-ray diffraction (XRD) patterns of the resulting crystalline Al—Fe—Si alloy samples: Sample 1 (20), Sample 2 (30), Sample 3 (40), and Sample 4 (50). Representative peaks of the h-Al—Fe—Si crystalline phase are labeled with triangles (Δ), representative peaks of the o-Al—Fe—Si crystalline phase are labeled with circles (○), and representative peaks of the t-Al—Fe—Si crystalline phase are labeled with squares (□). The respective amounts, by weight, of each of the h-Al—Fe—Si, o-Al—Fe—Si, and t-Al—Fe—Si crystalline phases in each of the samples at ambient temperature are shown in Table 3 below.

TABLE 3

| | h-Al—Fe—Si (%) | o-Al—Fe—Si (%) | t-Al—Fe—Si (%) |
|---|---|---|---|
| Sample 1 | 68 | 13 | 19 |
| Sample 2 | 84 | <0.1 | 16 |
| Sample 3 | 84 | 4 | 12 |
| Sample 4 | 89 | 2 | 9 |

The above description of preferred exemplary embodiments, aspects, and specific examples are merely descriptive in nature; they are not intended to limit the scope of the claims that follow. Each of the terms used in the appended claims should be given its ordinary and customary meaning unless specifically and unambiguously stated otherwise in the specification.

What is claimed is:

1. A method of manufacturing a crystalline aluminum-iron-silicon alloy, the method comprising:

providing a composite powder containing an alloy of aluminum (Al), iron (Fe), and silicon (Si), the composite powder including an amorphous phase and a first crystalline phase having a hexagonal crystal structure at ambient temperature; and heating the composite powder at a temperature in the range of 850° C. to 950° C. to transform at least a portion of the amorphous phase into the first crystalline phase and to transform the composite powder into a crystalline aluminum-iron-silicon (Al—Fe—Si) alloy, wherein the first crystalline phase is a predominant phase in the crystalline Al—Fe—Si alloy, and wherein the first crystalline phase accounts for greater than 65%, by weight, of the crystalline Al—Fe—Si alloy.

2. The method set forth in claim 1 wherein the first crystalline phase comprises, on an atomic basis, 64-66.5% aluminum (Al), 24-25% iron (Fe), and 9.5-11% silicon (Si).

3. The method set forth in claim 1 wherein the first crystalline phase exhibits lattice parameters of a=0.7509 nm±0.005 nm and c=0.7594 nm±0.005 nm.

4. The method set forth in claim 1 wherein the first crystalline phase exhibits a $P6_3/mmc$ crystallographic space group.

5. The method set forth in claim 1 wherein the first crystalline phase has a density of less than 5.0 g/cm$^3$.

6. The method set forth in claim 1 wherein the crystalline Al—Fe—Si alloy comprises a second crystalline phase exhibiting at least one of an orthorhombic or a triclinic crystal structure, and wherein the second crystalline phase accounts for less than 32%, by weight, of the crystalline Al—Fe—Si alloy.

7. The method set forth in claim 1 wherein the composite powder is heated at a temperature in the range of 900° C. to 930° C. to transform at least a portion of the amorphous phase into the first crystalline phase, and wherein the first crystalline phase accounts for greater than 85%, by weight, of the crystalline Al—Fe—Si alloy.

8. The method set forth in claim 7 wherein the crystalline Al—Fe—Si alloy comprises a second crystalline phase exhibiting at least one of an orthorhombic or a triclinic crystal structure, and wherein the second crystalline phase accounts for less than 15%, by weight, of the crystalline Al—Fe—Si alloy.

9. The method set forth in claim 1 wherein the composite powder comprises, by weight, 41-55% aluminum (Al), 33-48% iron (Fe), and 9-13% silicon (Si).

10. The method set forth in claim 1 wherein the composite powder is prepared by:

providing a precursor material in powder form, the precursor material containing aluminum (Al), iron (Fe), and silicon (Si); and mechanically alloying the precursor material.

11. The method set forth in claim 10 wherein the precursor material comprises at least one of a mixture of metal powders or a pre-alloyed metal powder.

12. The method set forth in claim 1 wherein the composite powder is not formed by rapid solidification of a molten material.

13. A method of manufacturing a crystalline aluminum-iron-silicon alloy part, the method comprising:

providing a composite powder containing an alloy of aluminum (Al), iron (Fe), and silicon (Si), the composite powder including an amorphous phase and a first crystalline phase having a hexagonal crystal structure at ambient temperature;

introducing the composite powder into a die;

heating the composite powder in the die at a temperature in the range of 850° C. to 950° C. to transform at least a portion of the amorphous phase into the first crystalline phase and to transform the composite powder into a crystalline aluminum-iron-silicon (Al—Fe—Si) alloy, wherein the first crystalline phase is a predominant phase in the crystalline Al—Fe—Si alloy; and consolidating the crystalline Al—Fe—Si alloy in the die to produce a solid crystalline Al—Fe—Si alloy part, wherein the first crystalline phase accounts for greater than 65%, by weight, of the crystalline Al—Fe—Si alloy.

14. The method set forth in claim 13 wherein the composite powder is heated in the die for a duration in the range of 0.5 hours to 36 hours.

15. The method set forth in claim 13 comprising:

exposing the composite powder to a sub-atmospheric pressure environment or to an inert gas environment in the die.

16. The method set forth in claim 13 wherein the crystalline Al—Fe—Si alloy is consolidated in the die using at least one powder metallurgy process selected from the group consisting of: compaction, sintering, hot forging, powder forging, hot consolidation, hot pressing, hot isostatic pressing, cold isostatic pressing, and hot extrusion.

17. The method set forth in claim 13 wherein the crystalline Al—Fe—Si alloy is consolidated within the die by heating the crystalline Al—Fe—Si alloy at a temperature in the range of 850° C. to 950° C. and applying a pressure to the crystalline Al—Fe—Si alloy in the range of 100 kN/m$^2$ to 500 kN/m$^2$ for a duration in the range of 20 seconds to 40 seconds.

18. The method set forth in claim 13 wherein the crystalline Al—Fe—Si alloy part comprises a component for an internal combustion engine.

19. A method of manufacturing a crystalline aluminum-iron-silicon alloy, the method comprising:

providing a composite powder containing an alloy of aluminum (Al), iron (Fe), and silicon (Si), the composite powder including an amorphous phase and a first crystalline phase having a hexagonal crystal structure at ambient temperature; and heating the composite powder to transform at least a portion of the amorphous phase into the first crystalline phase and to transform the composite powder into a crystalline aluminum-iron-silicon (Al—Fe—Si) alloy without melting the composite powder, wherein the first crystalline phase is a predominant phase in the crystalline Al—Fe—Si alloy, with a weight fraction of the first crystalline phase in the crystalline Al—Fe—Si alloy being greater than that of all other crystalline phases in the crystalline Al—Fe—Si alloy.

20. The method set forth in claim 19 wherein the first crystalline phase accounts for greater than 65%, by weight, of the crystalline Al—Fe—Si alloy.

* * * * *